United States Patent [19]

LeDuc et al.

[11] Patent Number: 4,936,522

[45] Date of Patent: Jun. 26, 1990

[54] COLLAPSIBLE REWIND SPINDLE

[75] Inventors: Robert A. LeDuc, West Lebanon, N.H.; William M. Tamone, White River Junction, Vt.

[73] Assignee: New Jersey Machine Inc., Fairfield, N.J.

[21] Appl. No.: 331,502

[22] Filed: Mar. 31, 1989

[51] Int. Cl.[5] ..... B65H 75/24

[52] U.S. Cl. ..... 242/72 R

[58] Field of Search ..... 242/46.4, 46.2, 46.21, 242/46.3, 72 R, 72.1, 110, 110.1, 110.2, 115, 68.2

[56] References Cited

U.S. PATENT DOCUMENTS

| | | | |
|---|---|---|---|
| 2,682,924 | 7/1954 | Lomazzo et al. | 242/72 X |
| 2,762,577 | 9/1956 | Herr | 242/72 R |
| 3,341,147 | 9/1967 | Nystrand | 242/72 R |
| 4,674,701 | 6/1987 | Dreher et al. | 242/72 R X |
| 4,763,850 | 8/1988 | Hausner | 242/72 X |

*Primary Examiner*—Donald Watkins
*Attorney, Agent, or Firm*—Charles E. Baxley

[57] ABSTRACT

A rewind spindle has a bearing defining a rotation axis and a main rod supported on the bearing for rotation about the axis and having an outer face forming a part-cylindrical outer surface centered on the axis and extending angularly at most about 180° of the axis and an inner face lying wholly within an imaginary cylinder centered on the axis and coextensive with the outer surface. This inner face has a lower end forming an axially directed seat and an upper end. A filler rod has a lower end complementarily interfittable with the seat, an axially opposite upper end, a part-cylindrical outer surface of the same radius of curvature as the imaginary cylinder and outer surface of the main rod, and an inner face. This filler rod is displaceable when its lower end is fitted on the seat between an outer position with its outer surface coaxial with the outer surface of the main rod and lying on the imaginary cylinder and an inner position with its outer surface lying within the imaginary cylinder of the outer surface of the main rod. A link is engageable between the opposite end of the filler rod and the main rod for releasably retaining the filler rod in the outer position. Thus after winding a web up on the spindle with the filler rod retained in the outer position, the spindle can be collapsed for removal of the wound-up web by releasing the filler rod and moving same into its inner position.

10 Claims, 1 Drawing Sheet

COLLAPSIBLE REWIND SPINDLE

SPECIFICATION

1. Field of the Invention

The present invention relates to a takeup rewind spindle. More particularly this invention concerns such a spindle used to take up a web in a labeling operation.

2. Background of the Invention

In various production operations, for instance labeling, it is necessary to wind up a carrier web or tape on a spindle and to periodically strip from the spindle the coil of web. This can be a particular problem because the continuous tension maintained in the web in many operations, in particular where the spindle is continuously urged into rotation but actually is rotated intermittently, causes the web to be wound very tightly around the spindle. It therefore is occasionally necessary to at least partially unwind the web in order to strip it from the spindle.

OBJECTS OF THE INVENTION

It is therefore an object of the present invention to provide an improved spindle for winding up a continuous web.

Another object is the provision of such an improved spindle for winding up a continuous web which overcomes the above-given disadvantages, that is which allows even a very tightly wound web to be removed from the spindle with relative ease.

SUMMARY OF THE INVENTION

A rewind spindle according to this invention has a bearing defining a rotation axis and a main rod supported on the bearing for rotation about the axis and having an outer face forming a part-cylindrical outer surface centered on the axis and extending at most about 180° angularly of the axis and an inner face lying wholly within an imaginary cylinder centered on the axis and coextensive with the outer surface. This inner face has a lower end forming an axially directed seat and an upper end. A filler rod has a lower end complementarily interfittable with the seat, an axially opposite upper end, a part-cylindrical outer surface of the same radius of curvature as the imaginary cylinder and outer surface of the main rod, and an inner face. This filler rod is displaceable when its lower end is fitted on the seat between an outer position with its outer surface coaxial with the outer surface of the main rod and lying on the imaginary cylinder and an inner position with its outer surface lying within the imaginary cylinder of the outer surface of the main rod. A link is engageable between the opposite end of the filler rod and the main rod for releasably retaining the filler rod in the outer position. Thus after winding a web up on the spindle with the filler rod retained in the outer position, the spindle can be radially collapsed for removal of the wound-up web by releasing the filler rod and moving same into its inner position.

Such an arrangement therefore allows the web to be wound up and, once a spool of sufficient size is formed of this web which is then normally discarded, the link is released to collapse the spindle. The reduction in size makes it very easy to pull off the waste.

According to this invention both inner faces are substantially planar and are spaced from and parallel to each other in the outer position of the filler rod and in the outer position both inner faces symmetrically flank the axis.

The seat in accordance with this invention is an axially directed formation on the lower end of the inner face of the main rod and the lower end of the filler rod is complementary thereto. Furthermore in order to allow the spindle to stop rotating, even when being continuously driven, the drive includes a continuously rotating element and a clutch between the element and the main rod for transferring rotation of the former to the latter with slip.

The seat of the system of this invention can be a redially extending and axially upwardly open slot in which case the filler rod has a tongue engageable therein. More particularly the seat includes a pin transversely bridging the notch and the tongue is formed with a notch complementary to the pin. In the same vein the main rod has an upper end formed with a radially throughgoing slot opening at the inner face and the link is pivoted on the filler rod and engageable in the slot of the main rod. This link carries a spacer engaged between the inner faces in the outer position of the filler rod and when the link is engaged in the slot of the main rod.

DESCRIPTION OF THE DRAWING

The above and other objects, features, and advantages will become more readily apparent from the following, reference being made to the accompanying drawing in which.

SPECIFICATION

Figure 1:
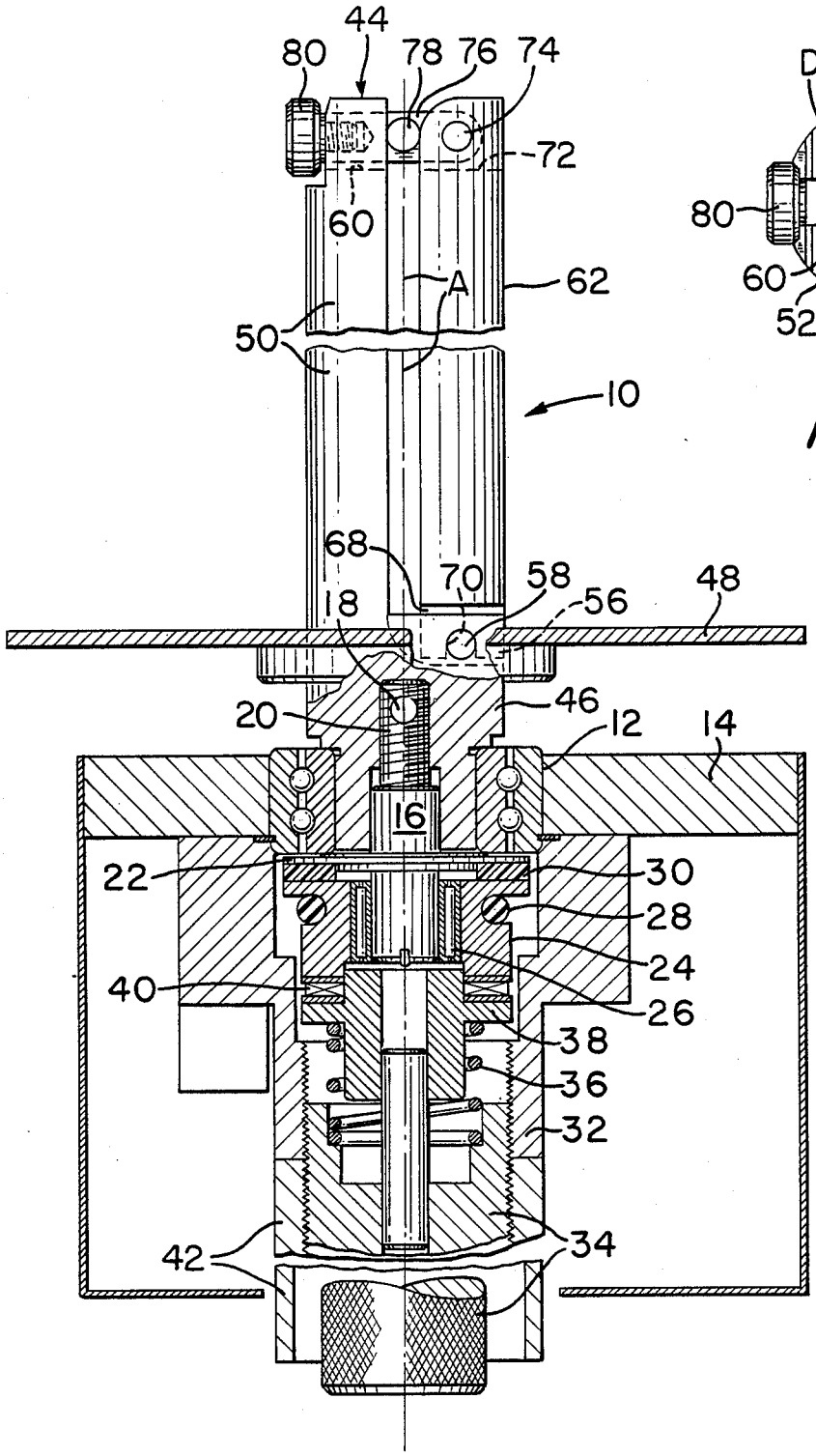
FIG. 1 is a partly sectional side view of the spindle according to this invention.
Figure 2:
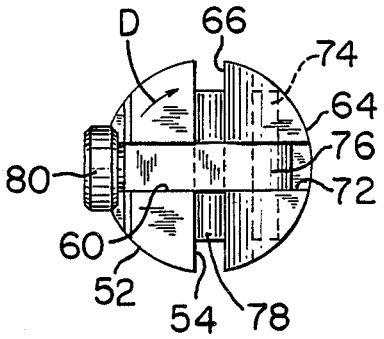
FIG. 2 is a top view of the spindle.

As seen in the drawing a spindle assembly 10 is force fitted inside the inner race of a double-row ball bearing 12 whose outer race is fixed in a stationary support plate 14. The bearing 12 defines for the spindle assembly 10 a normally vertical support axis A, although of course the system of this invention would work upside down or with the axis A horizontal or inclined to the horizontal. A stud 16 has a threaded upper end 20 screwed into the lower end of the spindle assembly 10 and carries an upper clutch plate 22 and therebelow by means of a needle bearing 26 a pulley 24. A belt 28 engaged around this pulley 24 rotates it continuously about the axis A in the direction indicated by arrow D in FIG. 2.

The upper face of the pulley 24 carries a friction disk 30 axially engageable with the clutch plate 22. An internally threaded sleeve 32 fixed to the table 14 and centered on the axis A receives an adjustment nut 34 that can be threaded up and down in it and that bears via a spring 36 on the lower face of a pusher element 38 in turn bearing via an axial-thrust bearing 40 on the lower edge of the pulley 24. Thus this nut 34 can be screwed up into the sleeve 32 to increase the force with which the element 38 bears on the pulley 24 and, hence, the rotational coupling between the friction disk 30 and plate 22, and vice versa. A lock sleeve 42 is provided to allow the nut 34 to be locked in position on the sleeve 32 once the desired level of torque transmission is set.

The spindle assembly 10 comprises a main rod 44 having a lower end portion 46 of cylindrical shape centered on the axis A and carrying a support plate 48 extending perpendicular to this axis A and serving to support a coil of web being wound up. An upper portion 50 of the main rod 44 is of generally semicylindrical shape centered on the axis A, having an outer surface 52 (see FIG. 2) extending over slightly less than 180° and an inner face 54 that is planar and that extends parallel to the axis A but between this axis A and the surface 52.

In addition the lower end portion 46 is formed with a radially extending and axially upwardly open slot 56 perpendicularly traversed by a seat pin 58. The uppermost end of the upper portion 50 is similarly formed with a radially throughgoing and axially upwardly open slot 60 diametrally aligned with the slot 56.

A filler rod 62 of substantially the same shape as the upper portion 50, that is with a part-cylindrical outer surface 64 and a flat inner face 66, has a lower end formed with a tongue 68 centrally formed with a downwardly open notch 70. The tongue 68 is dimensioned to fit into the slot 56 with the notch 70 fitting over the pin 58. At its upper end this filler rod 62 is formed with another radially throughgoing and axially upwardly open slot 72 bridged by a pin 74 acting as pivot for a link 76 itself provided centrally with a spacer pin 78 and at its outer end with a locking screw 80.

Under normal circumstances the tongue 68 of the filler rod 62 is fitted into the slot 56 with the notch 70 over the pin 58 and the link 76 is fitted into the slot 60. The spacer 78 keeps the two rods 50 and 62 apart so their surfaces 52 and 64 lie on an imaginary cylinder centered on the axis A. The screw 80 is tightened to maintain these parts in this position by clamping the uppermost end of the rod between the pin 78 and the head of the screw 80.

The drive is started up to rotate the pulley 24, thereby rotating the assembly 10 by friction through the clutch formed by the disk 30 and plate 22. The amount of force transmission through this clutch is adjusted by means of the nut 34 to hold the web, which in a labeling operation is typically payed out in steps, taut without applying so much tension that this web ruptures.

Once the spindle assembly 10 is full the drive is stopped and the web is cut. Then the screw 80 is loosened and the link 76 pulled up. This pulls the spacer 78 out from between the rods 50 and 62 and allows the rod 62 to tip inward. Such movement of this rod 62 makes it possible to pull it axially up and out of the coil on the assembly 10 altogether, whereupon the coil can be lifted easily off the main rod 50.

We claim:

1. A rewind spindle comprising:

a bearing defining a rotation axis;

a main rod supported on the bearing for rotation about the axis and having an outer face forming a part-cylindrical outer surface centered on the axis and extending angularly at most about 180° angularly of the axis and an inner face lying wholly within an imaginary cylinder centered on the axis and coextensive with the outer surface, the inner face having a lower end forming an axially directed seat and an upper end;

a filler rod having a lower end complementarily interfittable with the seat, an axially opposite upper end, a part-cylindrical outer surface of the same radius of curvature as the imaginary cylinder and outer surface of the main rod, and an inner face, the filler rod being displaceable when its lower end is fitted on the seat between an outer position with its outer surface coaxial with the outer surface of the main rod and lying on the imaginary cylinder and an inner position with its outer surface lying within the imaginary cylinder of the outer surface of the main rod; and link means engageable between the opposite end of the filler rod and the main rod for releasably retaining the filler rod in the outer position, whereby after winding a web up on the spindle with the filler rod retained in the outer position, the spindle can be collapsed for removal of the wound-up web by releasing the filler rod and moving same into its inner position.

2. The collapsible rewind spindle defined in claim 1 wherein both inner faces are substantially planar and are spaced from and parallel to each other in the outer position of the filler rod.

3. The collapsible rewind spindle defined in claim 2 wherein in the outer position both inner faces symmetrically flank the axis.

4. The collapsible rewind spindle defined in claim 1 wherein the seat is an axially directed formation on the lower end of the inner face of the main rod and the lower end of the filler rod is complementary thereto.

5. The collapsible rewind spindle defined in claim 1, further comprising drive means for rotating the rods about the axis.

6. The collapsible rewind spindle defined in claim 5 wherein the drive means includes a continuously rotating element and clutch means between the element and the main rod for transferring rotation of the former to the latter with slip.

7. The collapsible rewind spindle defined in claim 1 wherein the seat is a radially extending and axially upwardly open slot, the filler rod having a tongue engageable therein.

8. The collapsible rewind spindle defined in claim 7 wherein the seat includes a pin transversely bridging the notch and the tongue is formed with a notch complementary to the pin.

9. The collapsible rewind spindle defined in claim 1 wherein the main rod has an upper end formed with a radially throughgoing slot opening at the inner face and the link is pivoted on the filler rod and engageable in the slot of the main rod.

10. The collapsible rewind spindle defined in claim 9 wherein the link carries a spacer engaged between the inner faces in the outer position of the filler rod and when the link is engaged in the slot of the main rod.

* * * * *